United States Patent [19]

Burke

[11] Patent Number: 4,640,512

[45] Date of Patent: Feb. 3, 1987

[54] INTERACTIVE BOOK-PUZZLE INSTRUCTIONAL ENTERTAINMENT SYSTEM

[76] Inventor: William B. Burke, 407 Nassau Dr., Springfield, Mass. 01129

[21] Appl. No.: 832,023

[22] Filed: Feb. 24, 1986

Related U.S. Application Data

[63] Continuation-in-part of Ser. No. 779,629, Sep. 24, 1985.

[51] Int. Cl.[4] ..... A63F 9/10

[52] U.S. Cl. ..... 273/157 R; 434/178; 434/406; 434/333

[58] Field of Search ..... 273/157 R; 434/178, 434/406, 333

[56] References Cited

U.S. PATENT DOCUMENTS

| | | | |
|---|---|---|---|
| 601,811 | 4/1898 | Landes | 273/157 R |
| 1,359,115 | 11/1920 | Sittinger | 273/157 R X |
| 1,477,322 | 12/1923 | Degheri | 434/406 |
| 1,701,557 | 2/1929 | Clinch et al. | 273/157 R UX |
| 2,481,109 | 9/1949 | Grace | 273/157 R |
| 2,875,531 | 3/1959 | Mansfield | 434/406 |
| 3,815,920 | 6/1974 | Carter et al. | 273/157 R |

FOREIGN PATENT DOCUMENTS

| | | | |
|---|---|---|---|
| 13920 | of 1890 | United Kingdom | 273/157 R |

OTHER PUBLICATIONS

"The One, The Only, The Original Jigsaw Puzzle Book" by Francene and Louis Sabin, publ. by Henry Regnery Comp., Chicago, copyright 1977, p. 102.

*Primary Examiner*—Anton O. Oechsle

*Attorney, Agent, or Firm*—Ross,

[57] ABSTRACT

An interactive book-puzzle instructional entertainment system envisions a story book of consecutively-arranged pages with different indicia and a portion of a complemental supporting story imprinted on each of the consecutive pages, and a jigsaw puzzle including a plurality of separable playing pieces. Each piece bears on one side a duplicate representation of an indicia appearing on one of the pages of the book and bears on the opposite side a portion of a complete picture. The participant matches the indicia of each page of the book with the indicia on each playing piece with each successive piece being playable according to the consecutive order of their appearance in the book. That is, the pieces are playable consecutively, each piece is interlocked so that the second piece is interjoined with the first piece and the third piece is interjoined somewhere along the continuous edge provided by the previously interjoined first and second pieces. Each successively played piece is interjoined somewhere along the continuous edge provided by the sum of the previously interjoined pieces.

1 Claim, 10 Drawing Figures

INTERACTIVE BOOK-PUZZLE INSTRUCTIONAL ENTERTAINMENT SYSTEM

CROSS REFERENCES TO RELATED APPLICATIONS

The application is a continuation in part of my application bearing Ser. No. 06/779,629 and filing date of Sept. 24, 1985.

BACKGROUND OF THE INVENTION

1. Field of the Invention

In the arts of instructional and entertainment materials for children, a desideratum is to provide an educational element into that which entertains or an entertainment element into that which instructs so as to keep the child's attention directed along certain lines while, at the same time, teaching and amusing the child.

In pursuance of this purpose, I have provided certain improvements in the way of a book having educational, instructive and amusement qualities together with associated puzzle means having qualities on the same order and which, though physically separated from said book-element, is inter-related therewith, so that the two said elements are used conjointly in carrying out the scheme by which they are co-related.

Primarilly, I provide a means for solving a mystery puzzle, the result of which is not known until the participant completes the puzzle.

2. Description of the Prior Art

Under the provisions of 37 CFR 1.97-1.99, the following art is cited:

Kennedy M.—U.S. Pat. No. 959,754
Washburn—U.S. Pat. No. 2,848,823
Irwin—U.S. Pat. No. 3,193,294
Leven—U.S. Pat. No. 3,302,310
Wilson—U.S. Pat. No. 3,540,732
Spector—U.S. Pat. No. 3,707,287
Fogle et al—U.S. Pat. No. 4,052,074

While these references each teach what can be broadly construed as jigsaw puzzles, no patent found teaches the use of two interactive components, first, a story book of consecutively-arranged pages with different indicia and a portion of a complemental supporting story imprinted on each of the consecutive pages and second a jigsaw puzzle including a plurality of separable playing pieces, which are supportive of each other in that a player is called upon to successively match the indicia appearing on each page of the book with the indicia on the playing pieces with each successive playing piece being playable in accordance with the consecutive order of their appearance in the book. In jigsaw puzzle fashion, the pieces are interlocked in a manner where the second to be played piece is interjoined with the first to be played piece and the third to be played piece is interjoined somewhere along the continuous edge provided by the previously interjoined first and second pieces, with each successively coded piece being interjoined somewhere along the continuous edge provided by the previously interjoined pieces.

SUMMARY OF THE INVENTION

One real thrust of the invention lies in the fact that in the course of puzzle buildup, that which the participant constructs is in the form of a mystery, he knowing only that the picture he is developing will have some relationship to the story appearing in the book from which he gathers intelligence in the way of locating the playing pieces in a consecutive order matching the consecutive order of the subject matter appearing in the successive pages of the book which he reads.

The construction and arrangement by means of which I have carried out the above stated idea is that of a book having in printed text and pictures a certain story or theme with the pictures supporting the text and/or the text supporting the pictures appearing on the successive pages of the book.

The detached puzzle pieces represent the pieces of a jigsaw puzzle and their proper assemblage into the completed puzzle being left to the child who at the time is using or participating in the use of the book.

To this is added the element of mystery in that, unlike most jigsaw puzzles the player is privileged to see a reproduction, usually on the cover of the piece-containing box, of the picture as it will appear when the puzzle is properly completed, the player in this instance is not so privileged. He is allowed to endure the excitement of assembly of the puzzle before he can realize what he has assembled. In this way, a more animated spirit is thereby given to the puzzle-device and the interest of the user is accordingly increased.

BRIEF DESCRIPTION OF THE PREFERRED EMBODIMENT

Figure 4A:
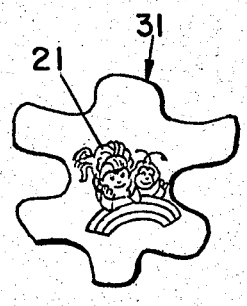
FIG. 4A is a picture of a playing piece on one side of which is a representation of what is shown on page 1 of the book, such piece being identified as the number 1 playing piece.
Figure 4B:
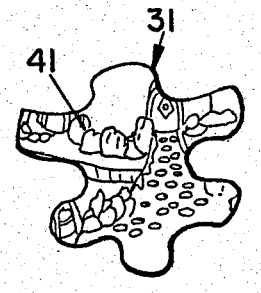
FIG. 4B is a picture of the number 1 playing piece of FIG. 4A showing the representation appearing on the obverse side of the piece, which side will be used in the building of the puzzle.
Figure 1:
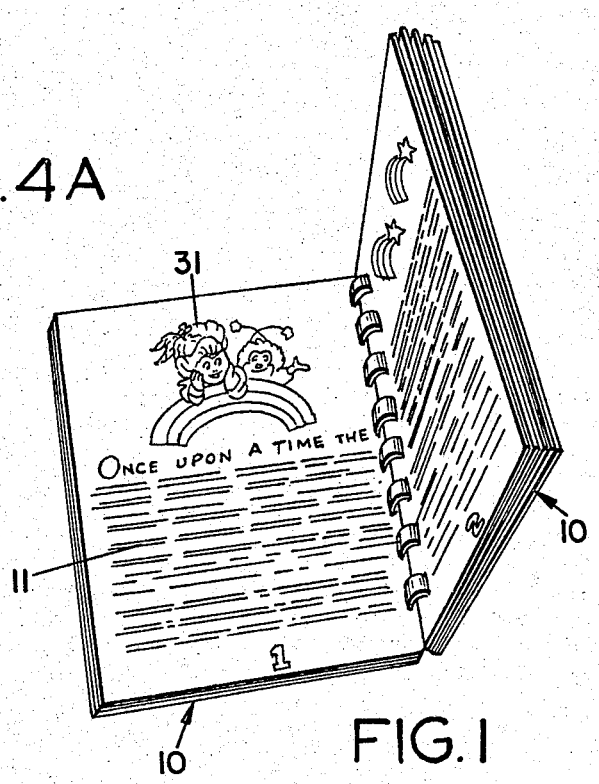
FIGS. 1, 2 and 3 are views in perspective of the book opened to what is showing as pages 1 and 2 and 3 respectively.
Figure 2:
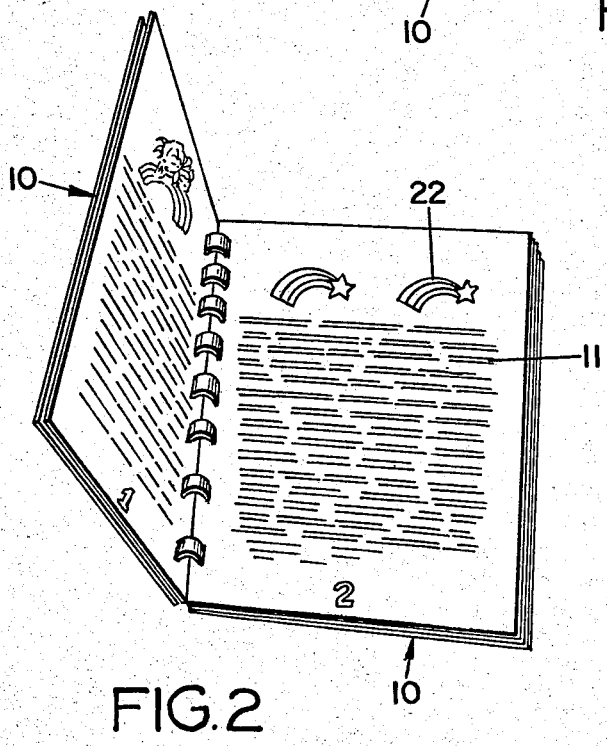
Figure 5A:
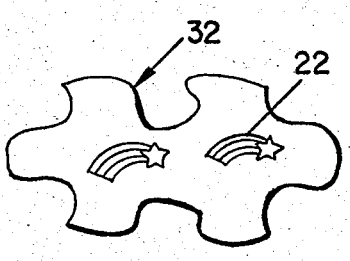
FIG. 5A is a picture of a playing piece on one side of which is a representation of what is shown on page 2 of the book, such piece being identified as the number 2 playing piece.
Figure 5B:
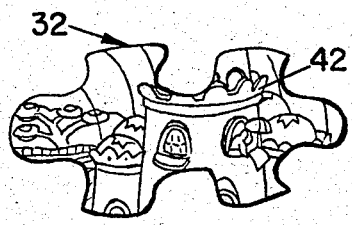
FIG. 5B is a picture of the number 2 playing piece of FIG. 5A showing the representation appearing on the obverse side of the piece, which side will be used in the building of the puzzle.
Figure 6A:
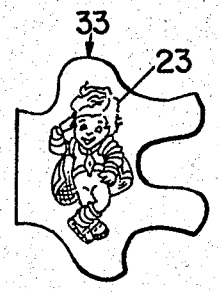
FIG. 6A is a picture of a playing piece on one side of which is a representation of what is shown on page 3 of the book, such piece being identified as the number 3 playing piece.
Figure 6B:
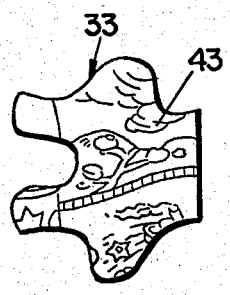
FIG. 6B is a picture of the number 1 playing piece of FIG. 6A showing the representation appearing on the obverse side of the piece, which side will be used in the building of the puzzle.
Figure 3:
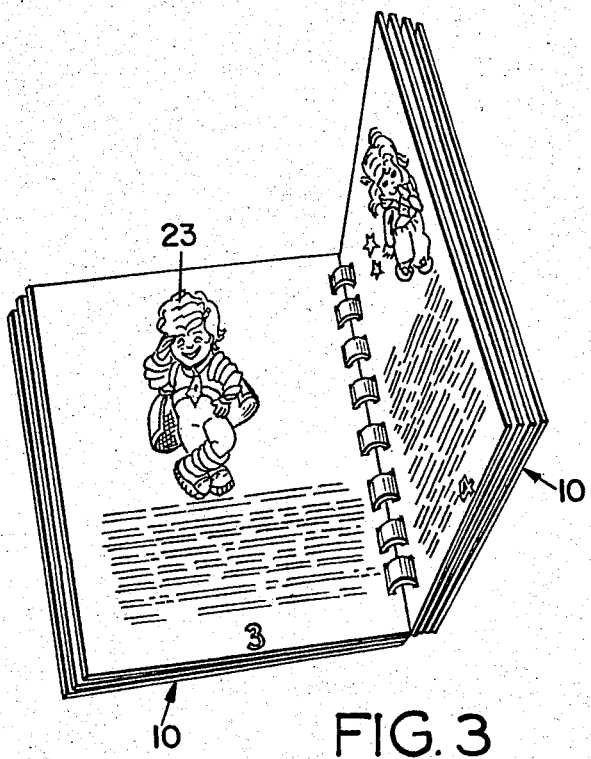
Figure 7:
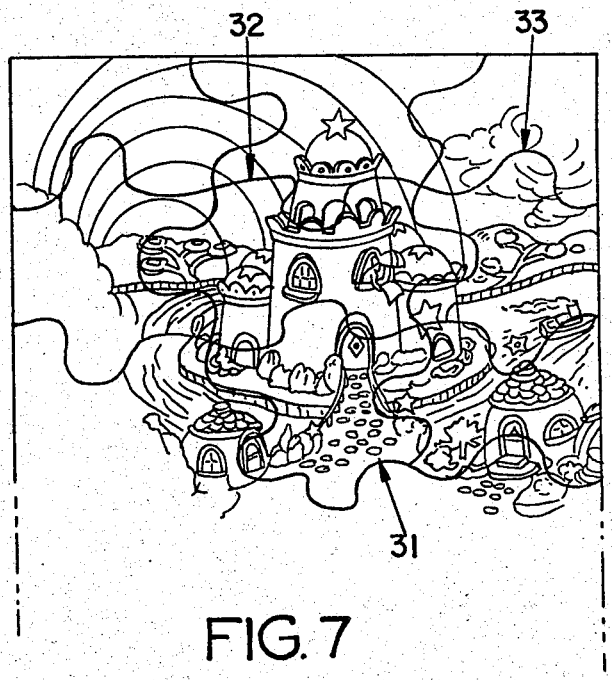
FIG. 7 is a fragmentary view in plan of the puzzle being built showing the number 1, 2 and 3 playing pieces in situ together with several other playing pieces likewise in place.

Referring to the drawings, the leaves of the book are suitably bound between covers 10 into a substantial book in which are found numbered pages 1, 2, 3, 4, etc., etc., identified in the drawings by the very numbers of the pages themselves in order to simplify referencing.

On the different pages of the book I arrange different text matter represented by dash lines 11 as shown and different cooperating illustrations, the text and illustrations telling or depicting a certain juvenile story, the burden of which may be of any suitable characters designed to instruct and amuse the child.

In the present instance, the story or theme which I have portrayed in the book relates to a pair of twins who are leaning on a rainbow (shown on page 1), the rainbow being shown as supporting at one of its ends a star (shown on page 2), with a little boy who is about to meet the twins (shown on page 3), etc., etc.

In this way, the story that is told by the book may be imparted to the child by reading to him or by having him read the text and showing the pictures in turn.

In thus using the book, the child is naturally much interested in the pictures illustrating the story and will follow them keenly and they will impress the child perhaps more than the text matter, and following this trend of thought in the child's mind so vividly created by the pictures, I utilize the same in conjunction with a detached set of puzzle pieces which the child will bring into play as he reads the story and views its pictures.

For example, in reading the story, the child is introduced, on page 1, to the pair of twins pictured at 21 on the page.

The child is then invited to find the particular playing piece carrying that representation printed on one of its faces and after picking the pieces over he finds the correct playing piece numbered 31 and bearing the same picture 21.

Having found the correct piece, the first playing piece in his picture building effort and, of course, that piece agreeing with the number of the page from which it was copied, the child is instructed to invert piece 21 and to start his picture building.

The part of the picture 41 revealed on that inverted piece 21 will have a relationship to the picture 21 which will become apparent only after the child has completed the puzzle.

The child then turns to page 2 of his book where he is introduced to the fact that there is a star at one end of the rainbow supporting the twins. This is pictured at 22 in the book, on page 2 thereof, and is also pictured on the obverse side of a second playing piece 32 which the child is asked to find.

Finding the rainbow with the star 22 on the playing piece 32, the child then inverts the playing piece bearing a part of a picture 42 and the child is given to understand that said playing piece may now be interJoined with playing piece 31, the two picture parts, of course, being interrelated.

The child then turns to page 3 of his book where he is introduced to the boy, by picture and text, who in due course will meet the twins. The boy is pictured at 23 in the book, on page 3 thereof, and is also pictured at 43 on the obverse side of a third playing piece 33 which the child is asked to find.

Finding the boy, the child then inverts the playing piece 33 and is given to understand that said playing piece may now be interjoined with playing pieces 31 and 32.

The key point here and the heart of the invention lies in the concept that starting with the play of piece 31, it follows that piece 32 may be interconnected in the usual jigsaw puzzle manner to piece 31. Then it further follows that piece 33 may be interconnected not necessarily to piece 32 but to the so-called "island" represented by the interjoined pieces 31 and 32. Likewise, it continues to follow that piece 34, the next-to-be-played piece, will be interjoined somewhere with the enlarging "island" represented by the combination of pieces 31, 32 and 33.

The playing pieces are played consecutively in the order that they are referred to by the player, i.e. piece 31 first, piece 32 second, piece 33 third, etc., etc. This serves as a clue to the player as to the order in which the pieces are to be "played," commencing with piece 31, followed by piece 32, etc.

The playing pieces are provided so as to form a complete picture when all thereof are properly interjoined, but the real point is that the child is not given in advance a copy of the picture which he is building, ergo the mystery element.

Stated otherwise, each of the individual pieces of the puzzle, when played in consecutive order, can be fitted or interlocked with any of the preceding interlocked pieces.

It is the intent that the individual pieces will be so configured that they may be interlocked according to only one single plan so as to give the correct solution.

The incentive in assembling the pieces is that the outer periphery of the continually-growing "island" defines the continuous edge to which each successive piece may be progressively interlocked.

The player starts with piece 31, treating same as an island which as he continues play will be seen to grow. Piece 32 which he next plays will be interjoined with piece 31 in the familiar manner of working a jigsaw puzzle. The island will be seen now to comprise pieces 31 and 32. Piece 33 is next played, same being interjoined with the growing "island" (pieces 31 and 32) and not necessarily adjoining and interfitting with the next preceding piece 32. The fourth piece will be next played, same being now interlocked at some appropriate location along the edge defined by the island defined by pieces 31 and 32 and 33.

I claim:

1. An interactive book-puzzle-instructional entertainment system comprising:

a story book of consecutively-arranged pages with different indicia and a portion of a complemental supporting story imprinted on each of the consecutive pages, and a jigsaw puzzle including a plurality of separable playing pieces, with each playing piece bearing on one side a duplicate representation of an indicia appearing on one of the pages of the book and bearing on the opposite side a portion of a complete picture, all adapted and arranged for a participant to successively match the indicia of each page of the book with the indicia on each playing piece with each successive piece being playable according to the consecutive order of their appearance in the book, the pieces being playable consecutively, each being interlocked in a manner where the second to be played piece is interjoined with the first to be played piece and the third to be played piece is interjoined somewhere along the continuous edge provided by the previously interjoined first and second pieces, with each successively coded piece being interjoined somewhere along the continuous edge provided by the previously interjoined pieces.

* * * * *